US008997627B2

(12) United States Patent
Passarelli

(10) Patent No.: US 8,997,627 B2
(45) Date of Patent: Apr. 7, 2015

(54) THERMAL ENGINE WITH AN IMPROVED VALVE SYSTEM

(76) Inventor: Paul Michael Passarelli, Norwalk, CT (US)

( * ) Notice: Subject to any disclaimer, the term of this patent is extended or adjusted under 35 U.S.C. 154(b) by 337 days.

(21) Appl. No.: 13/455,488

(22) Filed: Apr. 25, 2012

(65) Prior Publication Data

US 2012/0272821 A1 Nov. 1, 2012

Related U.S. Application Data

(60) Provisional application No. 61/480,510, filed on Apr. 29, 2011.

(51) Int. Cl.
*F01B 1/06* (2006.01)
*F01B 31/26* (2006.01)

(52) U.S. Cl.
CPC .. *F01B 1/06* (2013.01); *F01B 31/26* (2013.01)

(58) Field of Classification Search
CPC ..... F01B 1/06; F01B 1/062; F01B 31/26; F01B 13/061; F02B 53/00; F04B 1/0439; F04B 1/0408
USPC ..... 123/43 R, 45 R, 18 R; 137/635.18, 137/625.19, 625.46, 625.47; 417/269, 438, 417/273; 61/480, 510; 60/670; 92/72; 91/491, 474, 497, 61, 482, 180, 914
See application file for complete search history.

(56) References Cited

U.S. PATENT DOCUMENTS

| | | | | |
|---|---|---|---|---|
| 470,978 | A * | 3/1892 | Bruce | 91/6.5 |
| 513,650 | A | 1/1894 | Grant | |
| 3,301,233 | A * | 1/1967 | Dotto et al. | 123/243 |
| 3,931,809 | A * | 1/1976 | Corte et al. | 123/43 R |
| 4,183,285 | A | 1/1980 | Stevenson | |
| 4,481,917 | A * | 11/1984 | Rus et al. | 123/190.12 |
| 4,516,606 | A | 5/1985 | Worley | |
| 4,639,202 | A * | 1/1987 | Mahanay et al. | 418/59 |
| 4,936,111 | A * | 6/1990 | Wilkinson et al. | 62/504 |
| 5,179,889 | A * | 1/1993 | Wusthof et al. | 91/491 |
| 5,220,893 | A * | 6/1993 | Costa | 123/225 |
| 5,720,241 | A * | 2/1998 | Gail | 123/44 C |
| 6,443,110 | B2 | 9/2002 | Qattan | |
| 6,615,775 | B2 | 9/2003 | Takemura et al. | |
| 6,776,130 | B2 | 8/2004 | Miyakoshi et al. | |
| 6,834,503 | B2 | 12/2004 | Freymann | |
| 6,843,162 | B2 * | 1/2005 | Shrive et al. | 91/491 |
| 7,080,512 | B2 | 7/2006 | Schoell | |
| 7,814,882 | B2 * | 10/2010 | Sakita | 123/241 |
| 2003/0005894 | A1 * | 1/2003 | Dougherty | 123/54.2 |
| 2003/0159578 | A1 * | 8/2003 | Shrive et al. | 92/72 |
| 2010/0100299 | A1 * | 4/2010 | Tripathi et al. | 701/102 |

* cited by examiner

*Primary Examiner* — Devon Kramer
*Assistant Examiner* — Jon Hoffmann
(74) *Attorney, Agent, or Firm* — UCONN IP Law Clinic; Michael A. Blake; Jane Djung

(57) ABSTRACT

A radial thermal engine with an improved valve system is disclosed herein comprising intake and exhaust port valve assemblies fluidly connected to respective intake and exhaust ports contained within a cylinder head assembly. Each intake and each exhaust port valve assembly comprises at least one rotatable port cover having spaced apart openings which are periodically alignable to the intake and exhaust ports, respectively.

20 Claims, 11 Drawing Sheets

THERMAL ENGINE WITH AN IMPROVED VALVE SYSTEM

CROSS REFERENCE TO RELATED APPLICATION

Applicant claims the benefit of provisional U.S. patent application, Thermal Engine with an Improved Valve System, 61/480,510, filed Apr. 29, 2011, which application is incorporated herein in its entirety.

TECHNICAL FIELD

The present invention is generally directed to a thermal piston engine. More particularly, the present invention is directed to a radial piston engine. Even more particularly, the present invention is directed to a valve system within a radial piston engine.

BACKGROUND OF THE INVENTION

Thermal engines play an indispensible role in everyday life. Environmental concerns have urged a need to design thermal engines which are more environmentally friendly, highly efficient and cost effective. The heat required by thermal engines may be provided from combustion of fuel, geothermal sources, solar radiation, or any other available heat source.

A thermal engine converts thermal energy captured from a heat source into mechanical energy, which can be either utilized directly to drive a mechanical device or further converted to electricity via a generator. A thermal engine may be either a piston engine or a turbine engine.

A piston engine comprises at least a cylinder, a piston, a crankshaft, and a working fluid. Generally, the working fluid undergoes thermodynamic cycles in the cylinder chamber, which drives the piston to move inside the respective cylinder, transmitting the resulting mechanical power through the crankshaft.

One of the efficiency-determining factors of a piston engine is the admission and exhaust of the working fluid into and out of the cylinder chamber. In most piston engines, the admission and exhaust processes are controlled by poppet valves. The dead space created by the position and configuration of the poppet valves and intake/exhaust ports is a major contribution to the low efficiency of piston engines.

Additionally, there are several other disadvantages associated with poppet valves: 1) the flow forces of the working fluid act directly in the direction of poppet motion, which creates an unbalanced force on the valve and makes its dynamic control difficult; 2) the poppet displacement to port opening area ratio is large, thus requiring very high resolution and high bandwidth poppet position control to maintain fine flow regulation; and 3) the design of a poppet valve is specific to the cylinder and port configuration of the engine. Thus, it is difficult for one valve design to adapt to different cylinder and port configurations.

SUMMARY OF THE INVENTION

Disclosed herein is a radial piston engine containing intake and exhaust ports on a cylinder head assembly comprising intake and exhaust port valve assemblies fluidly connected to respective intake and exhaust ports. Each intake and each exhaust port valve assembly comprises at least one rotatable port cover having spaced apart openings which are periodically alignable to the intake and exhaust ports, respectively.

The above described and other features are exemplified by the following figures and detailed description. The recitation herein of desirable objects which are met by various embodiments of the present invention is not meant to imply or suggest that any or all of these objects are present as essential features, either individually or collectively, in the most general embodiment of the present invention or in any of its more specific embodiments.

BRIEF DESCRIPTION OF THE DRAWINGS

The subject matter which is regarded as the invention is particularly pointed out and distinctly claimed in the concluding portion of the specification. The invention, however, may best be understood by reference to the following description taken in connection with the accompanying drawings in which are exemplary embodiments of the present invention:

DETAILED DESCRIPTION

The disclosed invention is a radial piston thermal engine with an improved valve system. In one embodiment, the engine includes a cylinder head assembly in which comprises intake and exhaust port valve assemblies. The port valve assemblies include intake and exhaust port drivers which mechanically drive intake and exhaust port covers. Two port covers are provided in the intake port valve assembly and two port covers are provided in the exhaust port valve assembly. The position of each port cover with its respective pair is controlled by an engine control unit (ECU) which enables the adjustment of engine variables, e.g. cycle timing, during operation. Each cylinder head assembly is on top of a cylinder. The cylinder contains a piston, which is connected to a crankshaft via a piston rod. The crankshaft mechanically drives the port cover drivers which mechanically drive the port covers.

Figure 1:
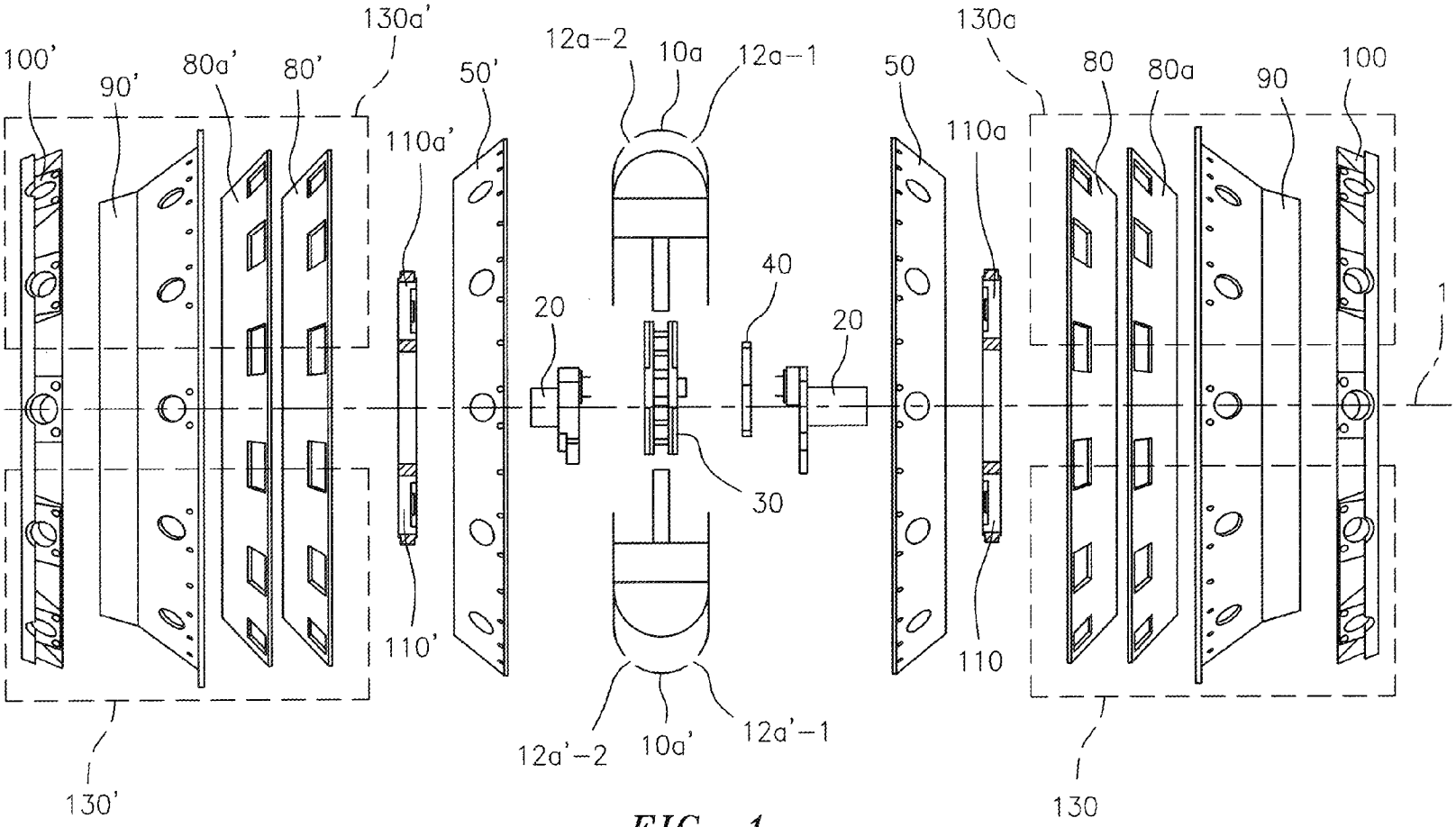
FIG. 1 is a diagrammatic exploded view of the present invention.

FIG. 1 is a diagrammatic exploded illustration of one embodiment of the present invention. The engine comprises a plurality of cylinders, e.g. 10*a* and 10*a*', each cylinder having a corresponding piston, two of which are shown by 11*a* and 11*a*' in FIG. 3B, each piston having attached to it a piston rod, two of which are shown by 13*a* and 13*a*' in FIG. 3B, each cylinder further having one intake port, e.g. 12*a*-1, and one exhaust port, e.g. 12*a*-2. The engine further comprises a crank 20, a master hub 30, a master linkage 40, two substantially identical head plates 50 and 50', two substantially identical intake port covers 80 and 80*a*, two substantially identical exhaust port covers 80' and 80*a*', two substantially identical top plates 90 and 90', two substantially identical manifolds 100 and 100', two substantially identical intake port planetary systems 110 and 110*a*, and two substantially identical exhaust port planetary systems 110' and 110*a*'.

The intake port covers 80 and 80*a*, the top plate 90 and the manifold 100 are contained within two substantially identical intake port valve systems 130 and 130*a*. The exhaust port covers 80' and 80*a*', the top plate 90' and the manifold 100' are contained within two substantially identical exhaust port valve systems 130' and 130*a*'. The intake port planetary systems 110 and 110*a* and intake port valve systems 130 and 130*a* in combination comprise the intake port drivers. The exhaust port planetary systems 110' and 110*a*' and exhaust port valve systems 130*a* and 130*a*' in combination comprise the exhaust port drivers.

Figure 2A:
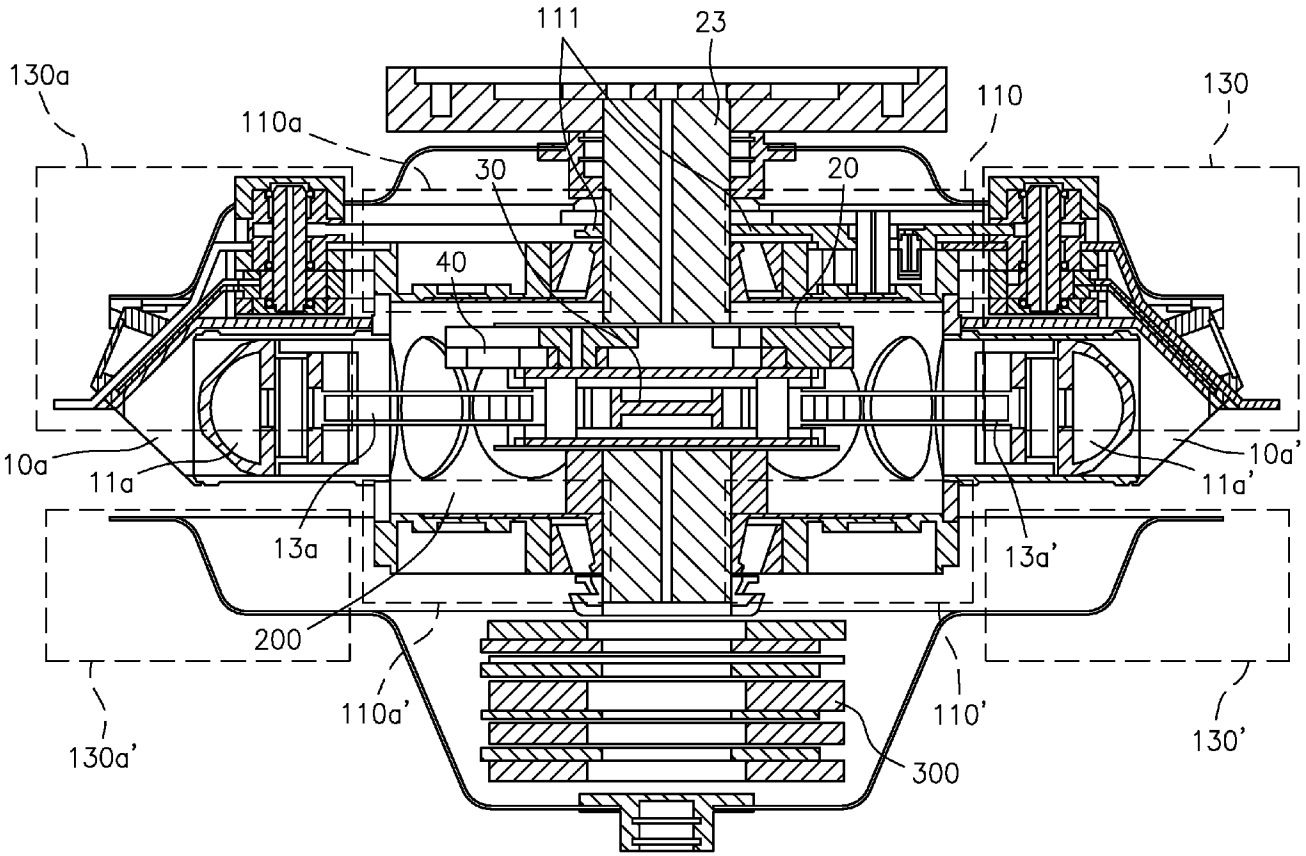
FIG. 2A is a sectional view of the present invention.

In one embodiment as shown in FIG. 2A, two cylinders, 10*a* and 10*a*', are placed substantially opposite to each other in cylinder block 200 and are substantially disposed in the same plane. Intake port valve system 130 is located above the cylinder 10*a*' and intake port valve system 130*a* is located above the cylinder 10*a*. The intake port valve systems 130 and 130*a* are substantially identical with intake port valve system 130 engaging intake port cover 80, and intake port valve system 130*a* engaging intake port cover 80*a*. Next to the intake port valve systems 130 and 130*a* and towards the crank 20 are two intake port planetary systems 110 and 110*a*.

In one embodiment, the exhaust port valve system 130' is located below the cylinder 10*a*' and the exhaust port valve system 130*a*' is located below the cylinder 10*a*. Next to the exhaust port valve systems 130' and 130*a*' and towards the crank 20 are two exhaust port planetary systems 110' and 110*a*'. The exhaust port valve system 130' and 130*a*' are substantially identical, with exhaust port valve system 130' engaging exhaust port cover 80' and exhaust port valve system 130*a*' engaging exhaust port cover 80*a*', as shown in FIG. 1.

In one embodiment, the planetary systems 110, 110*a*, 110' and 110*a*' provide input force for the port valve systems 130, 130*a*, 130' and 130*a*', respectively, and port covers 80, 80*a*, 80', 80*a*', respectively. The four planetary systems 110, 110*a*, 110' and 110*a*' are substantially identical to each other, and the four port valve systems 130, 130*a*, 130' and 130*a*' are substantially identical to each other.

Figure 2B:
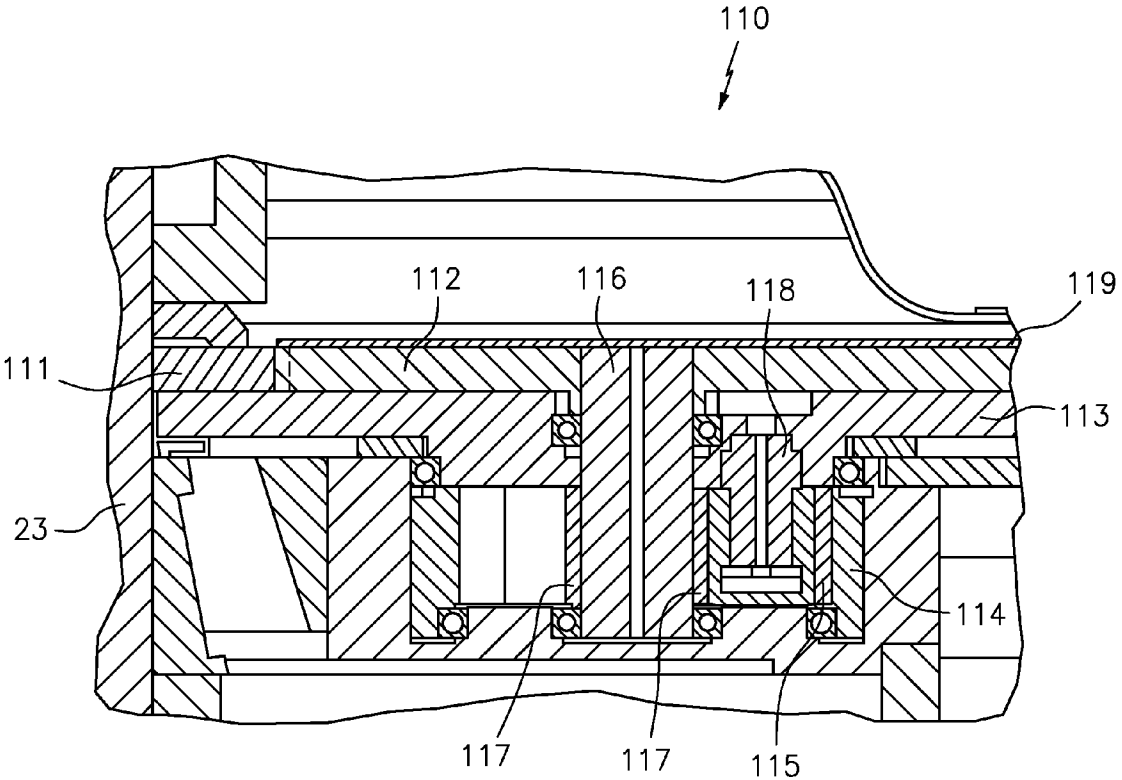
FIG. 2B is a sectional view of the intake port planetary system.

FIG. 2B illustrates one embodiment of a representative planetary system, which is mechanically driven by the crankshaft 23 to provide input force to the port valve systems and eventually the port covers. The planetary system also allows the ECU 400 to adjust the phase relationship of the port covers to the piston position in the cylinders. The intake port planetary system 110 comprises a transmission gear 112 connected to a transmission shaft 116, a planetary armature 113, three planetary rings, one of which is shown by 114, a planetary idler gear 115, a sun gear 117, three planet shafts, one of which is shown by 118, the planet shafts are fixed to the planetary armature 113, and a transmission cover 119. Each planet shaft engages a planetary ring. For example, planet shaft 118 engages planetary ring 114. The transmission gear 112 is driven by the crankshaft pinion 111, and subsequently drives the sun gear 117 via the transmission shaft 116. The sun gear 117 meshes with and rotates the planetary idler gear 115.

The planetary idler gear 115 subsequently meshes with and rotates the planetary rings, one of which is shown by 114, and subsequently rotates the planetary armature 113 via the planetary shafts, one of which is shown by 118. With the planetary ring 114 locked, an input rotation to the sun gear 117 produces an output rotation of the planetary armature 113. The rotation of the planetary armature 113 subsequently engages the intake port valve system 130, which ultimately drives the intake port cover 80.

The rotation of the sun gear 117 drives the planetary armature 113 in an angular velocity provided by the following equation: $\omega_{armature}=(\omega_{ring}+\omega_{sun}*(T_{sun}/T_{ring}))/(1+(T_{sun}/T_{ring}))$, where $\omega_{armature}$ is the angular velocity of the planet armature, $\omega_{ring}$ is the angular velocity of the planetary ring, $\omega_{sun}$ is the angular velocity of the sun gear, $T_{sun}$ is the number of teeth on the sun gear, and $T_{ring}$ is the number of teeth on the planetary ring. Here, $\omega_{ring}=0$ since the planetary ring is locked.

If sun gear 117 rotates at the same angular velocity as the crankshaft 23, one turn of the sun gear 117 will result in 1/(C−1), turns of the planetary armature 113 when the number of cylinders and ports are an even number. C is the number of cycles of the port cover. Accordingly, one turn of the sun gear 117 results in 1/C turns of the planetary armature 113 when the number of cylinders and ports are an odd number. In one embodiment, as shown in FIGS. 2-5, the engine has 12 cylinders and each port cover has 13 cycles. Thus, one turn of the sun gear 117 results in 1/12 turns of the planetary armature 113.

Even though rotation of the port covers is achieved in one embodiment described herein by the planetary systems, it will be understood by those skilled in the art that various changes may be made and equivalents, e.g. externally powered drivers, may be substituted without departing from the scope of the invention.

Figure 2C:
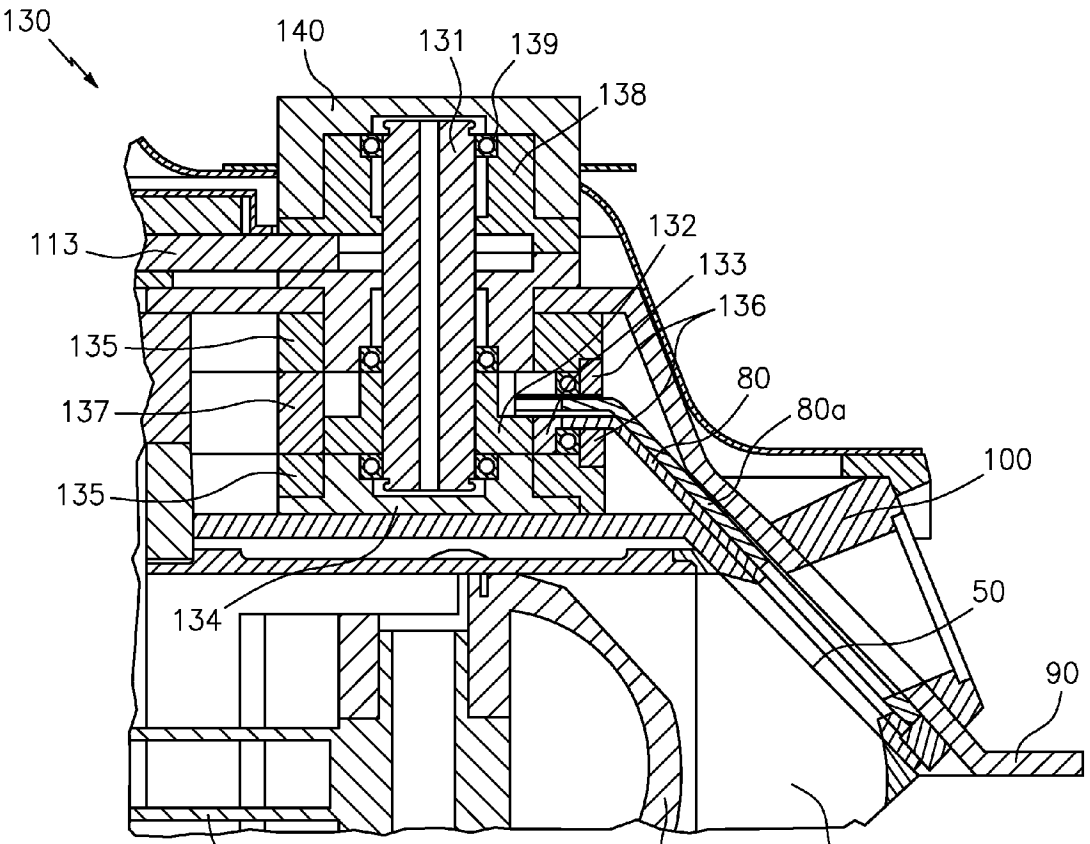
FIG. 2C is a sectional view of the intake port valve system.

FIG. 2C illustrates one embodiment of a representative valve system. The intake port valve system 130 comprises a head plate 50 on top of the cylinder 10*a*', which is followed by two port covers 80 and 80*a*, top plate 90, and manifold 100. The head plate 50 and the top plate 90 pack and secure the port covers 80 and 80*a* between them. The port covers 80 and 80*a* contained within the valve system 130 enable the admission of working fluid into the cylinder 10*a*'. The top plate 90 also serves as a casing for the engine, and supports the manifold 100, through which working fluid is conducted into the cylinder 10*a*'. Piston 11*a*' is contained in cylinder 10*a*', and is further connected to piston rod 13*a*'.

As further shown in FIG. 2C, the planetary armature 113, which is the output of the intake port planetary system 110, acts as a pinion for a stepped idler. This stepped idler engages the tower shaft 131, which then engages the spur pinion 132. The spur pinion 132 subsequently drives the spur gear 133, which ultimately drives the intake port cover 80.

In one embodiment of the present invention, as shown in FIG. 2C, the intake port valve system 130 further includes a sealing mechanism comprising a seal tower 138 capped by a seal cap 140, a tower shaft 131, a spur pinion 132 which drives a spur gear 133, a pressure disk 134, two bearing disks 135, two bearing rings 136 around the entire valve 130, a pressure rib 137, and six tower bridges, one of which is shown by 139. The tower shaft 131 is secured in the seal tower 138 by the tower bridges. The bearing disks 135 and bearing rings 136 also surround the seal tower 138. The two intake port covers 80 and 80*a* are located between the two bearing rings 136 and are spaced by a port cover spacer. The pressure rib 137, the seal tower 138, and the seal cap 140 provide the pressure seal and isolation of the valve plenum from the crankshaft case to retain the high pressure fluid within the intake port valve system 130 and to avoid pressure in the crankshaft case.

Figure 2D:
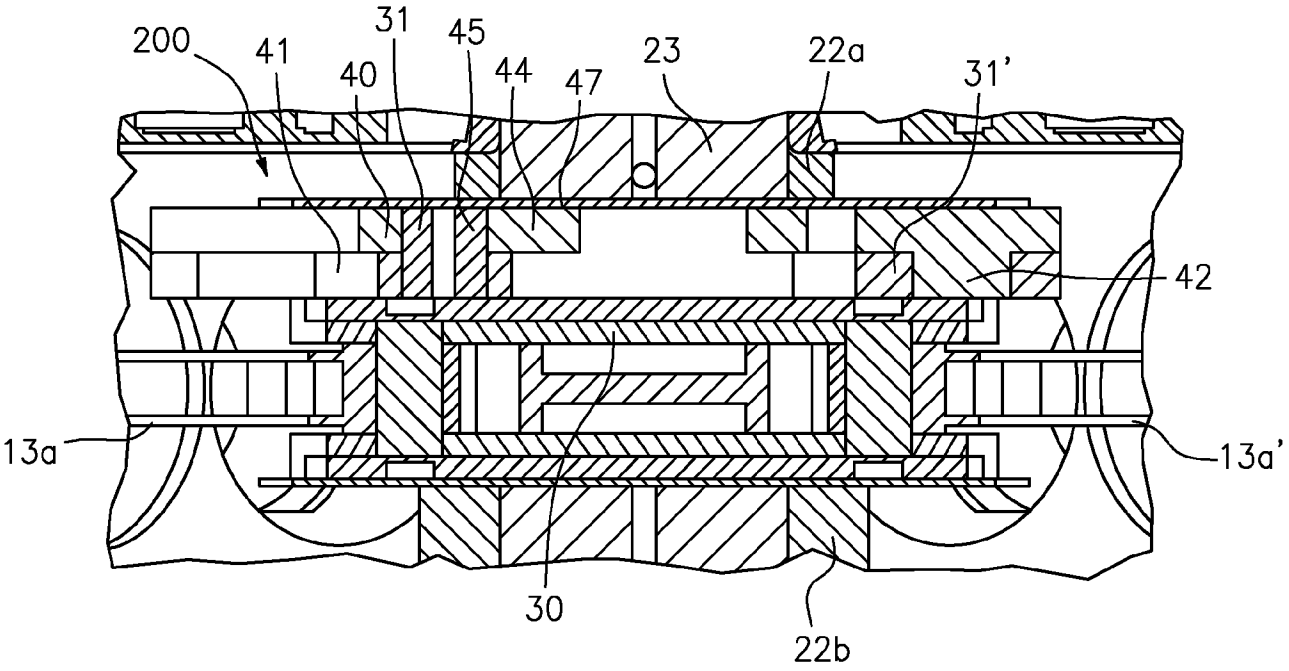
FIG. 2D is a sectional view of the master hub.
Figure 7C:
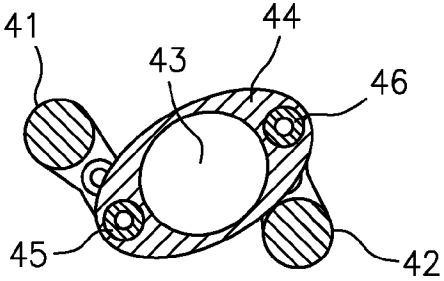
FIG. 7C is a sectional view of Section P-P illustrated in FIG. 7A.

In one embodiment shown in FIG. 2D, piston rods 13*a* and 13*a*' are connected to the periphery of the master hub 30 by their distal ends through two extended knuckle pins 31 and 31' that are locked to their respective connecting piston rods 13*a* and 13*a*'. A master linkage 40 is also connected to the master hub 30 via the extended knuckle pins 31 and 31'. The master linkage 40 comprises two linkage bars 41 and 42, and a master bar 44. The master bar 44 is connected to the two linkage bars 41 and 42 by two respective linkage pins 45 and 46, whereas linkage 46 is shown in FIG. 7C, and a master linkage cap 47.

In one embodiment shown in the combination of FIG. 1 and FIGS. 2A-2D, the master hub 30 is further connected to a crank 20. Crank 20 comprises two counter weights 22*a* and 22*b* and a crankshaft 23. Crankshaft 23 is encircled by two substantially identical crankshaft pinions, one of which is above the master hub 30, shown by 111 in FIG. 2B, and the other of which is below the master hub 30 is not shown. Each crankshaft pinion engages with two port planetary systems.

As shown in FIG. 2A, crankshaft pinion 111 above master hub 30 engages intake port planetary systems 110 and 110*a*. The crankshaft pinion below the master hub 30, which is not shown, engages the two exhaust port planetary systems 110' and 110*a*'. Each port planetary system then engages a valve system, which ultimately drives the port cover of that valve system. For example, as shown in FIG. 2A, intake port planetary system 110 engages intake port valve system 130.

Figure 3C:
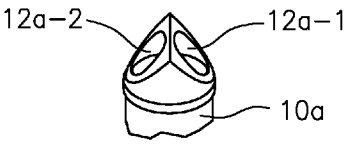
FIG. 3C is an isometric view of the cylinder head assembly comprising the intake and exhaust ports.
Figure 3B:
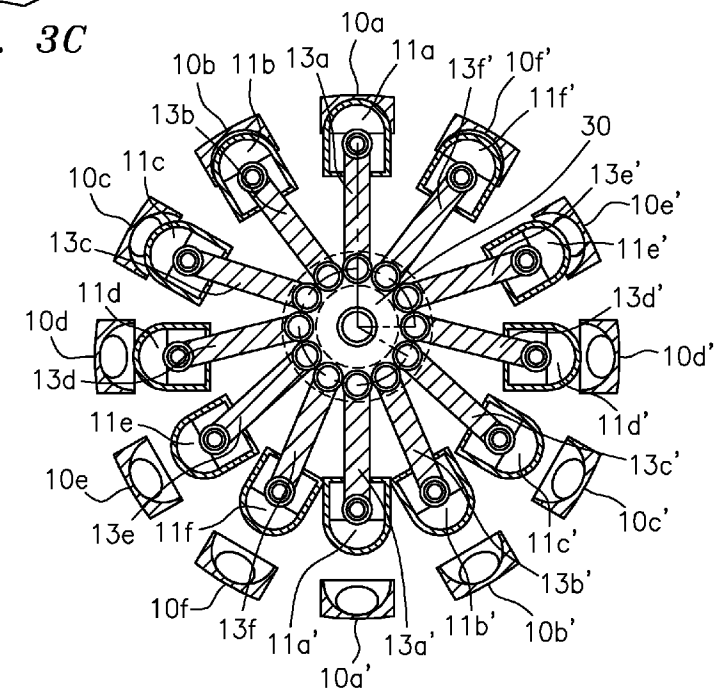
FIG. 3B is a sectional view of the exhaust ports.
Figure 3A:
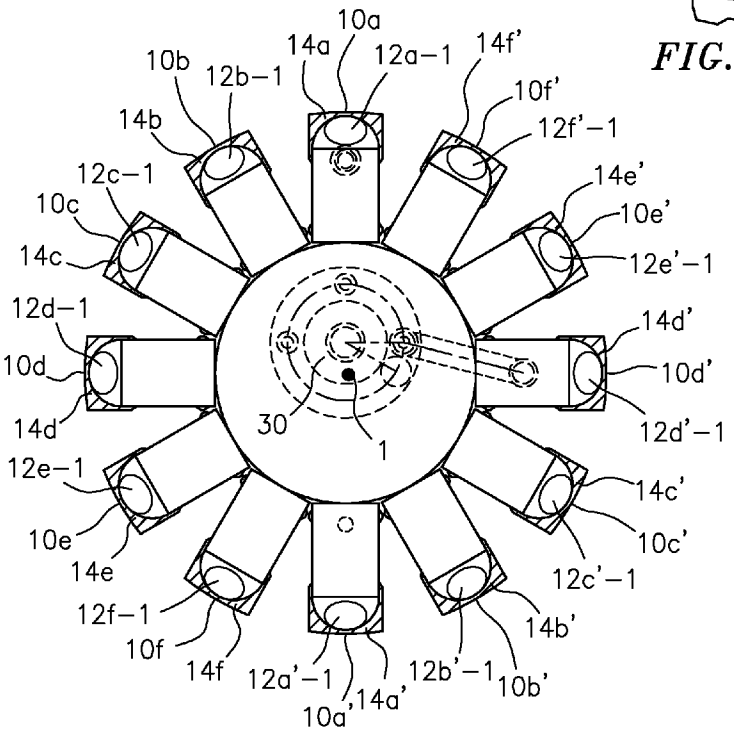
FIG. 3A is a sectional view of the intake ports.

FIGS. 3A-3C shows the arrangement of cylinder heads in which includes the cylinders, pistons, ports, and related elements for one embodiment of the invention. FIG. 3A illustrates a sectional view of the cylinder arrangement. This embodiment comprises twelve cylinders, referenced by 10*a*-10*f* and 10*a*'-10*f*', respectively. Each cylinder has an intake port and an exhaust port within its cylinder head assembly. The intake ports 12*a*-1-12*f*-1 and 12*a*'-1-12*f*'-1 are for cylinders 10*a*-10*f* and 10*a*'-10*f*', respectively. The cylinders 10*a*-10*f* and 10*a*'-10*f*' are configured radially in a planar surface with each cylinder head 14*a*-14*f* and 14*a*'-14*f*' extending outwards.

FIG. 3B illustrates a sectional view of the piston and piston rod arrangement. Pistons 11*a*-11*f* and 11*a*'-11*f*' correspond to cylinders 10*a*-10*f* and 10*a*'-10*f*', respectively. For each cylinder, as shown by a representative cylinder 10*a*, the head of cylinder 10*a* and its respective piston 11*a* are substantially hemispherical in shape with substantially the same curvature so that the head of cylinder 10*a* and piston 11*a* fit closely together, enabling a high compression ratio and minimal dead space. Each piston 11*a*-11*f* and 11*a*'-11*f*' is connected to the distal end of a corresponding piston rod 13*a*-13*f* and 13*a*'-13*f*', respectively, and each piston rod is mounted by its proximal end at substantially equal intervals around the periphery of the master hub 30.

FIG. 3C illustrates an isometric side view of one cylinder with its intake and exhaust ports. In one embodiment, the representative cylinder 10*a* comprises exhaust port 12*a*-2 in which substantially opposes intake port 12*a*-1. In addition, the ports are substantially positioned at a 45 degree angle from the upper surface of the piston within the cylinder. The 45 degree angle of the ports enable the rotating intake and exhaust port covers to not interfere with one another. Further, this 45 degree angle of the ports enable the working fluid to be efficiently introduced directly into the cylinders due to the minimum distance between the port cover and the cylinder.

Figure 4B:
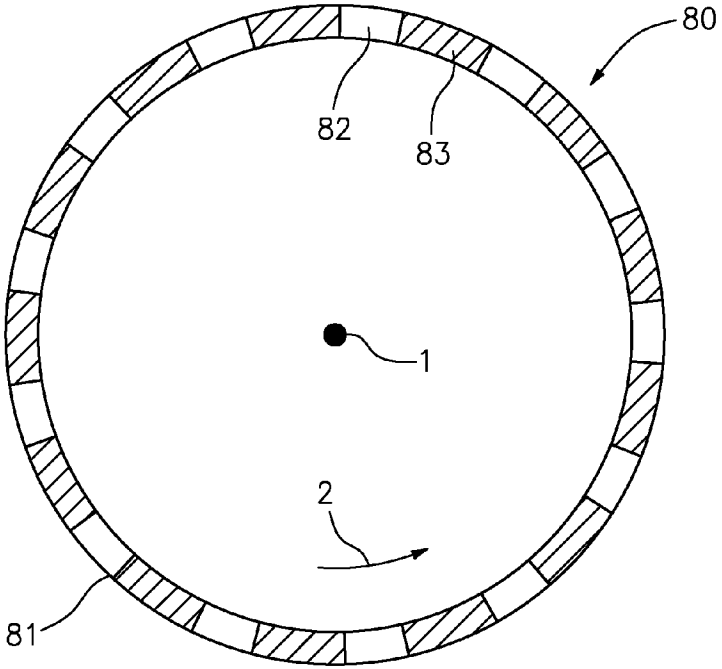
FIG. 4B is a sectional view of Section B-B illustrated in FIG. 4A.
Figure 4A:
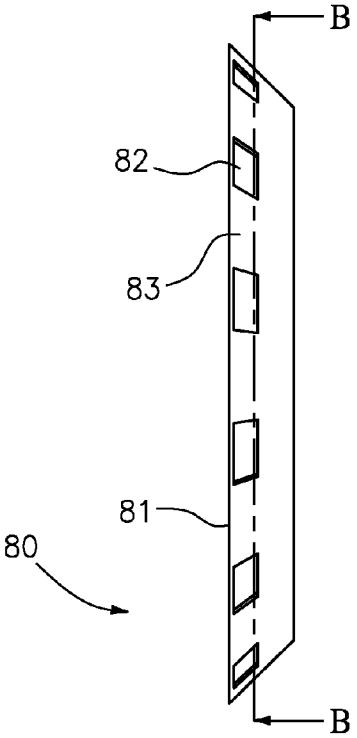
FIG. 4A is a diagrammatic view of a port cover.

FIG. 4A illustrates a diagrammatic view of a representative port cover 80, while FIG. 4B illustrates a sectional view of the port cover 80. In one embodiment, port covers 80, 80*a*, 80' and 80*a*' are substantially identical. Therefore, only intake port cover 80 is shown for purposes of a representative sample. The intake port cover 80 is a thin disk 81 in which is defined as a ruled surface comprising a cross-section of a truncated cone having an outer edge located at a greater distance away from a centerpoint than an inner edge, and the inner edge having a bent edge. The thin disk 81 has a plurality of openings, each opening having substantially the same dimensions. One opening is shown by 82. The area on the thin disk 81 in which does not have an opening is referred to as a "tooth." One such tooth area is shown by 83.

In one embodiment, the number of openings in a port cover is at least one greater than the number of intake/exhaust ports of the engine so that no less than one and up to half of the intake and exhaust ports may be open at one time. For example, the embodiment as shown in FIG. 3 has a 12-cylinder configuration, and hence each port cover in that embodiment has 13 openings.

Figure 5B:
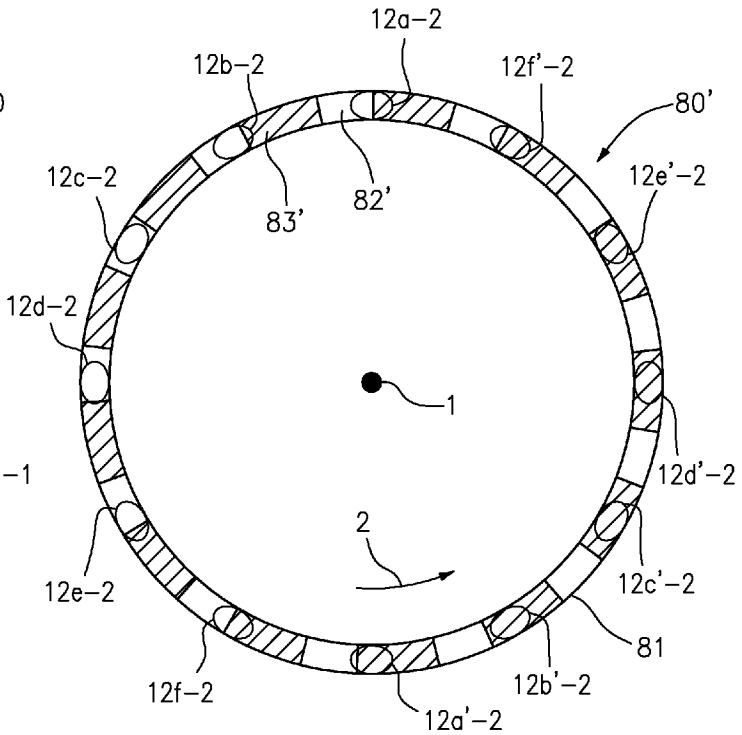
FIG. 5B is a diagrammatic view of a port cover in relation to exhaust ports.
Figure 5A:
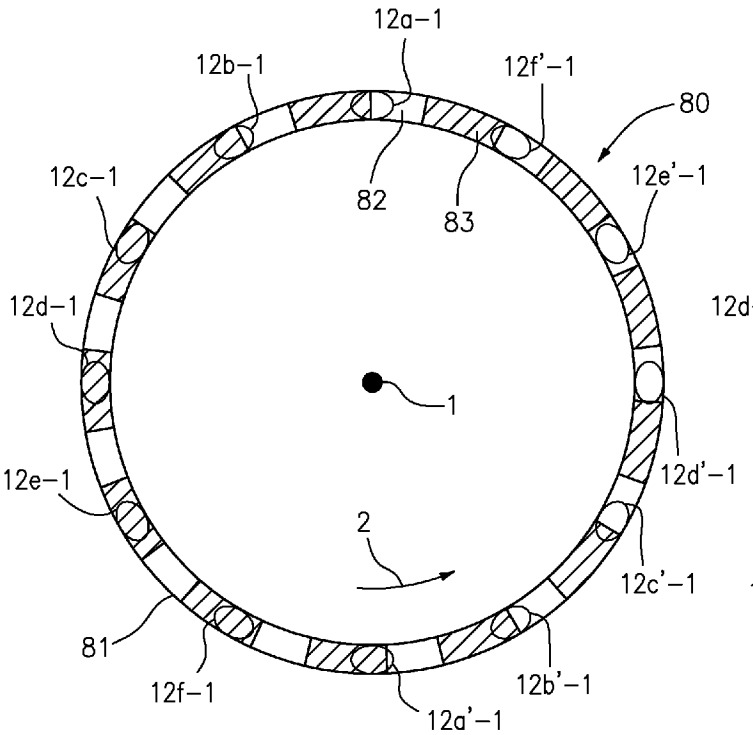
FIG. 5A is a diagrammatic view of a port cover in relation to intake ports.
Figure 6A:
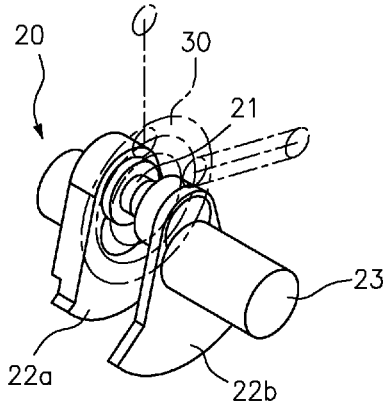
FIG. 6A is an isometric view of the crankshaft.
Figure 6B:
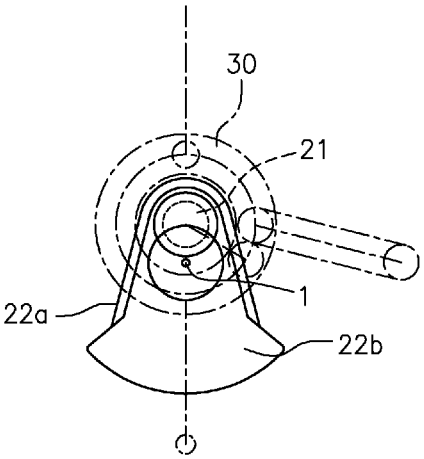
FIG. 6B is a side view of the crankshaft.
Figure 6D:
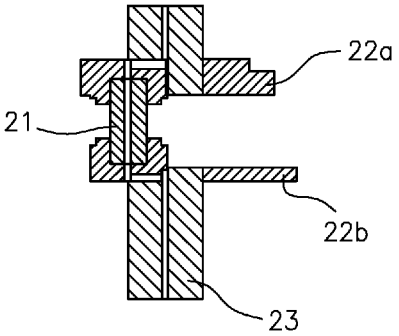
FIG. 6D is a sectional view of Section 6D illustrated in FIG. 6C.
Figure 6C:
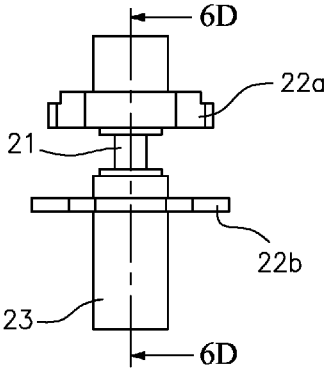
FIG. 6C is a top view of the crankshaft.

The intake ports 12*a*-1-12*f*-1 and 12*a*'-1-12*f*'-1, as shown in FIGS. 3A and 5A, are on the top side of the cylinder heads. The exhaust ports 12*a*-2-12*f*-2 and 12*a*'-2-12*f*'-2, as shown in FIG. 5B (12*a*-2 shown in FIG. 3C), are on the bottom side of the cylinder heads. In one embodiment as shown in FIGS. 5A-5B, each intake port and each exhaust port is substantially equally placed with respect to the center 1 of the planar surface of the cylinder configuration and is substantially equally distant from its respective adjacent port.

As used herein, a "closed" port is one which is substantially 100% blocked from a port cover, while an "open" port is one which is less than substantially 100% blocked from a port cover. As shown in the combination of FIG. 1 and FIGS. 5A-B, opening and closing of the intake and exhaust ports are controlled by the four planetary systems, 110, 110*a*, 110', and 110*a*', the four valve systems 130, 130*a*, 130', and 130*a*', and more specifically, the four port covers 80, 80*a*, 80' and 80*a*' contained in the respective valve systems. Two intake port covers 80 and 80*a* are for the intake ports 12*a*-1-12*f*-1 and 12*a*'-1-12*f*'-1 and the two exhaust port covers 80' and 80*a*' are for the exhaust ports 12*a*-2-12*f*-2 and 12*a*'-2-12*f*'-2. Intake port covers 80, 80*a*, and head plate 50 are in slideable and sealable contact with each other, and exhaust port covers 80' and 80*a*' and head plate 50' are in slideable and sealable contact with each other. Each port cover has a center of rotation on the center 1.

In one embodiment, the extent in which the intake and exhaust ports are open is enabled by aligning the openings of the port cover with its respective pair. The openings operate to permit the passage of the working fluid through the ports. The tooth areas form a barrier closing the ports to the passage of the working fluid.

As a port cover rotates, the passage of one tooth and one opening over a port constitutes one cycle. It is useful to maintain a cycle timing where each intake port and exhaust port of a given cylinder is open and closed for substantially equal amounts of time, referred to herein as "1:1 cycle timing." This substantially equal open/closed arrangement is beneficial for at least two reasons. First, the 1:1 cycle timing assures a uniform velocity of each piston traveling inside the respective cylinder for a multi-cylinder configuration. Second, the 1:1 cycle timing assures that each cylinder does not have more than one port open at one time. Failure to obtain the 1:1 cycle timing may cause both the intake port and the exhaust port for a given cylinder to be open at the same time. Such an occurrence may allow heated vapor to enter the cylinder and exhaust directly from the respective exhaust port without pushing the piston. Failure to obtain 1:1 cycle timing may also allow the cooled vapor originally contained in the cylinder to mix with incoming heated vapor. In either situation, the direction and/or the speed of the movement of the piston in the cylinder could be unfavorably altered.

Hence, in one embodiment of the disclosed invention, it is favorable to have 1:1 cycle timing. In order to do so, the tooth should be made longer than the opening in the direction 2 of the rotation of the port covers. This extra length is at least substantially equal to the diameter of the port opening in the cylinder head. As shown in FIGS. 4A-4B and 3C, the dimension of the representative opening 82 in the direction 2 of the rotation of port cover 80 is about two times the dimension of the intake port 12*a*-1. The dimension of the representative tooth area 83 in the direction 2 of the rotation of the port cover 80 is about three times the dimension of the intake port 12*a*-1 shown in FIG. 3C.

FIG. 5A provides a diagrammatic view of the intake ports 12*a*-1-12*f*-1 and 12*a*'-1-12*f*'-1 with intake port cover 80, while FIG. 5B provides a diagrammatic view of the exhaust ports 12*a*-2-12*f*-2 and 12*a*'-2-12*f*'-2 with exhaust port cover 80'. The combination of FIGS. 3B and 5A-5B illustrate the working mechanism of one embodiment of the disclosed invention. During the running of the engine, each cylinder undergoes the following stages:

First Stage: The piston head starts at the distal end inside the cylinder with respect to the center 1, as shown by cylinder 10*a* in FIG. 3B. At this point, the intake port 12*a*-1 for cylinder 10*a* is 100% open and the respective exhaust port 12*a*-2 has just closed. The opening of the intake port 12*a*-1 allows the working fluid to be admitted into the cylinder 10*a* for a portion of the crank 20 revolution.

Second Stage: The intake port gradually closes and the exhaust port remains closed. FIG. 3B, illustrates the cylinders undergoing this stage by the cylinders 10*f*-10*b*', as shown by intake ports 12*f*'-1-12*b*'-1 in FIG. 5A, and exhaust ports 12*f*'-2-12*b*'-2 in FIG. 5B. The heated vapor then pushes the piston radially inward, e.g. shown by 11*f*'-11*b*' in FIG. 3B, until it reaches the proximal end inside the cylinder, which begins the third stage, e.g. shown by cylinder 10*a*' in FIG. 3B. During the movement from the second stage to the third stage, the temperature of the vapor in the cylinder decreases due to its expansion.

Third Stage: The intake port closes and the exhaust port starts to open, as shown by 12*a*'-1 in FIGS. 5A and 12*a*'-2 in FIG. 5B.

Fourth Stage: The exhaust port gradually opens, as shown by cylinder 10*f* in FIGS. 3B and 12*f*-2 in FIG. 5B, until the exhaust port is 100% open, as shown by cylinder 10*e*-10*b* in FIGS. 3B and 12*e*-2-12*b*-2 in FIG. 5B. The intake port remains closed during this stage, as shown by 12*f*-1-12*b*-1 in FIG. 5A. The cooled vapor exits the cylinder from the exhaust port, as shown by cylinders 10*f*-10*b* and respective exhaust ports 12*f*-2-12*b*-2, and the piston, as shown by 11*f*-11*b*, moves radially outward until it returns to its position of the first stage, shown by cylinder 10*a*.

At a given time, each cylinder is at different degrees of a stage or different stages. As shown in FIG. 3B, cylinder 10*a* is at the end of the fourth stage and the beginning of the first stage, cylinders 10*f*'-10*b*' are in different degrees of the second stage, cylinder 10*a*' is at the third stage, while cylinders 10*f*-10*b* are in different degrees of the fourth stage. During the stages, movements of the pistons cause the associated piston rods to move radially inward and outward. In one embodiment, each port cover has one more opening than the number of intake or exhaust ports. As a result, no less than one and up to half of the intake ports and exhaust ports may be open at a time. As shown in FIG. 5A, at a given time, half of the intake ports, 12*b*'-1-12*f*'-1 and 12*a*-1, are open and half of the intake ports, 12*b*-1-12*f*-1 and 12*a*'-1, are closed. At the same time, as shown in FIG. 5B, when intake ports 12*b*'-1-12*f*'-1 and 12*a*-1 are open, their respective exhaust ports, 12*b*'-2-12*f*'-2 and 12*a*-2, are closed. Further, when intake ports 12*b*-1-12*f*-1 and 12*a*'-1 are closed, their respective exhaust ports 12*b*-2-12*f*-2 and 12*a*'-2 are open.

In one embodiment, the average speed of the port covers 80, 80*a*, 80', and 80*a*' is 1/12 the speed of the crankshaft 23. However, the instantaneous speed of the port covers may vary relative to 1/12 of the speed of the crankshaft 23. The differential alteration of speed between respective pairs of port covers effects the changes in the phase angle of the port covers to the crankshaft. These phase changes are the mechanism of timing the admission and exhaust events relative to the stroke of the respective piston.

In one embodiment, the intake port covers 80 and 80*a*, or exhaust port covers 80' and 80*a*' may be rotated at a different phase with respect to each other to allow one to vary the phase and duration of a port being opened within a period of time, thus adjusting the total volume of working fluid taken in or exhausted out of the cylinder. For example, intake port covers 80 and 80*a* may be oriented so that each opening and tooth area of each port cover is completely aligned or so that the tooth area of one port cover partially covers the opening of the other port cover.

FIGS. 6A-6D illustrate one embodiment of the crank 20. The crankshaft 23 may be connected to any device to supply rotary power, e.g. a generator or other machine as will be understood by one skilled in the art. In addition, the crankshaft 23 can also be used to drive a pump, e.g. as shown as 300 in FIG. 2A. The pump may provide pressurized lubrication oil to the bearings, scavenge the crankshaft case of oil mist and refrigerant vapor, and supply metered pressurized fluid to a receiving hydraulic device.

Figure 7B:
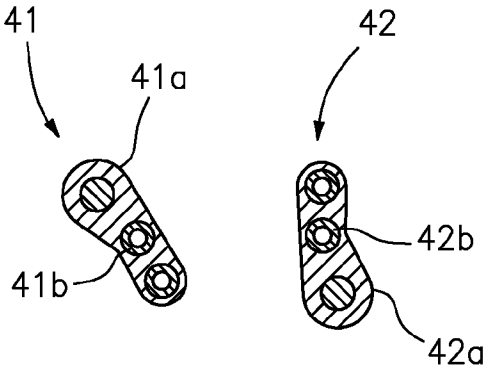
FIG. 7B is a sectional view of Section O-O illustrated in FIG. 7A.
Figure 7A:
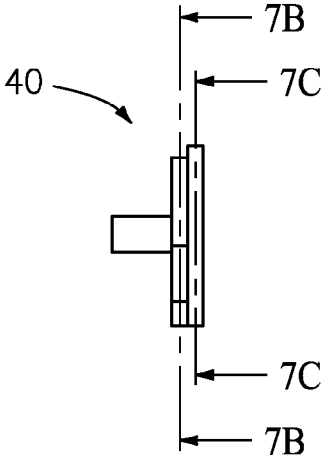
FIG. 7A is a side view of the master linkage.

FIGS. 7A-7C illustrates one embodiment of the master linkage 40. The master linkage comprises two linkage bars 41 and 42 in which are rotatably connected to the master bar 44 via two linkage pins 45 and 46. The master bar 44 has an opening 43. Each linkage bar 41 and 42 has an opening 41*b* and 42*b*, respectively. The linkage bars 41 and 42, and subsequently the master linkage 40, are connected to the master hub 30 through the extended knuckle pins 31 and 31', which are shown in FIG. 2D. The extended distal ends 41*a* and 42*a* of linkage bars 41 and 42, respectively, are of masses computed to keep the center of mass of the master linkage 40 substantially on the center of rotation 1.

In one embodiment, the invention employs an engine control unit ECU 400 to monitor the real time data of the instantaneous speed and/or position of each port cover together with other variables during the operation of the engine. The ECU 400 is a component of the intelligent system responsible for the efficient production of energy. The ECU 400 comprises a micro-controller with interfaces for sensors and is capable of communicating with common networks, e.g. the internet.

Figure 8:
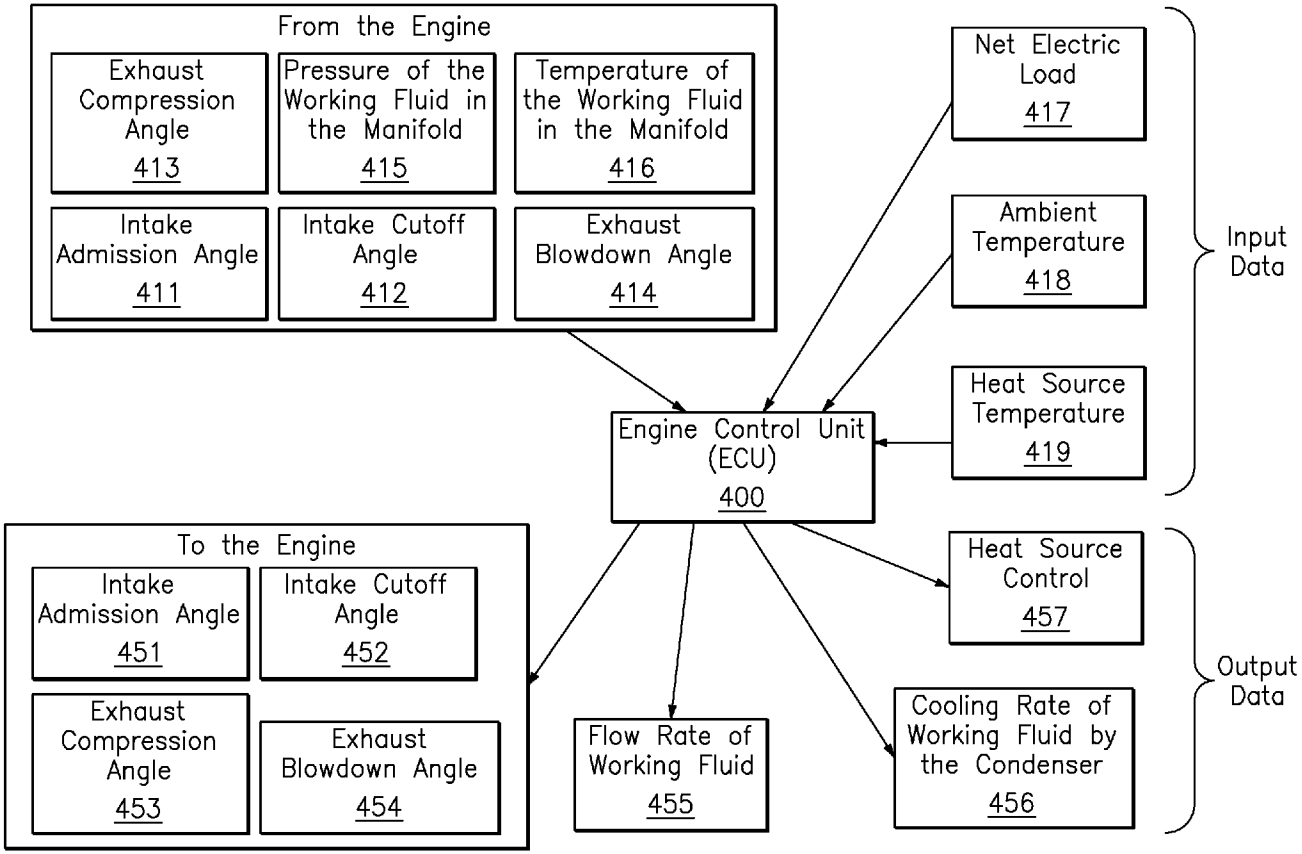
FIG. 8 is a block diagram of the engine control unit (ECU) architecture.

FIG. 8 shows a block diagram of one embodiment of the ECU 400 architecture. The ECU 400 employs various sensors, e.g. servomotors, steppermotors, temperature, pressure, and Hall-effect, to monitor and obtain from the engine system real-time input data of the valve settings. Such input data includes intake admission angle 411, intake cutoff angle 412, exhaust compression angle 413, and exhaust blowdown angle 414 to determine the instantaneous speed and/or position of each port cover, the pressure of the working fluid in the manifold 415, and the temperature of the working fluid in the manifold 416. The ECU also obtains input data from other components, e.g. net electric load 417, ambient temperature 418, and heat source temperature 419. The ECU 400 then computes input variables to determine the desired operating points of the engine system in real time. The resulting data is then compared with ideal values at multiple points of rotation and the deviation is used to compute the various control outputs to the system components.

In one embodiment, the control outputs to the engine include intake admission angle 451, intake cutoff angle 452, exhaust compression angle 453, and exhaust blowdown angle 454. These control outputs are used to adjust the speed of each port cover to its desired speed and to achieve differential alteration of speed between respective pairs of port covers. The ECU 400 is further capable of controlling the drive of the pump 300 to establish the flow rate and pressure of the working fluid 455. For example, the ECU can order an increase in the flow rate of the working fluid into the cylinder in order to speed up the revolution of the engine. The ECU 400 is also capable of controlling a condenser to adjust the cooling rate of the working fluid 456 to avoid excessive sub-cooling. The ECU 400 may further provide control data to the engine's heat source 457. For example, if the heat source is solar, the ECU 400 can adjust the angles of the collectors to optimize the amount of sunlight exposure.

In one embodiment, the input data of intake admission angle 411, intake cutoff angle 412, exhaust compression angle 413, and exhaust blowdown angle 414 and the output data of intake admission angle 451, intake cutoff angle 452, exhaust compression angle 453, and exhaust blowdown angle 454 refer to the relative positions of the port covers 80, 80*a*, 80', and 80*a*' in relationship to the respective ports and the crankshaft throw. The input data from the engine is monitored by the ECU 400 and instructions are sent to the engine to adjust any deviation of the port covers 80, 80*a*, 80', and 80*a*' from the desired values.

The basic functions of the ECU as described above allows for control of the system under steady state conditions, or when loads change gradually, as the feedback constantly adjusts deviations from the ideal conditions. In one embodiment, an extension to the basic ECU, referred to as a Full Authority Digital Engine Controller (FADEC), incorporates additional features that allow the FADEC to minimize deviations from the ideal operating points of the system based on a set of defined conditions. Thus, providing the FADEC the option to set the operating points in an anticipatory manner rather than as a simple feedback controlled loop.

Moreover, in one embodiment, if the ECU and FADEC were to become inoperable, the engine can also operate as a part of a Master Oscillator Power Amplifier (MOPA) to an external AC power source by replacing the ECU/FADEC with relay-switches. For example, if a small 50 W 60 Hz AC generator with good frequency stability is used as the exciter, the disclosed engine would be able to operate in such a mode that the engine will self-govern its rotational output to provide frequency-matched 60 Hz power.

While the invention has been described in detail herein in accordance with certain preferred embodiments thereof, many modifications and changes therein may be effected by those skilled in the art. Accordingly, it is intended by the appended claims to cover all such modifications and changes as fall within the spirit and scope of the invention.

It is noted that the use herein of the terms intake and exhaust are relative. It is well understood by a person having ordinary skill in the art that the intake valve structure can just as easily function as an exhaust valve structure when the engine turns in the opposite direction.

As with the case of a conventional thermal engine, it is also well understood by a person having ordinary skill in the art that such devices may also operate as fluid pumps when being driven as opposed to their operations providing motive power.

It is noted that the terms "first," "second," and the like, as well as "left," "right," and the like, as well as "top," "bottom," and the like, as well as "inward," "outward," and the like, as well as "rear," "front," and the like, as well as "distal," "proximal," and the like, as well as "above," "below," or the like, herein do not denote any amount, order, or orientation, but rather are used to distinguish one element from another, and the terms "a" and "an" herein do not denote a limitation of quantity, but rather denote the presence of at least one of the referenced item. As used herein the term "about", when used in conjunction with a number in a numerical range, is defined being as within one standard deviation of the number "about" modifies. The suffix "(s)" as used herein is intended to include both the singular and the plural of the term that it modifies, thereby including one or more of that term.

The invention claimed is:

1. A radial piston engine containing intake ports and exhaust ports on a cylinder head assembly, the engine comprising:

an intake port valve assembly fluidly connected to the intake ports of the cylinder head assembly, the intake port valve assembly comprising at least one rotatable intake port cover having spaced apart openings each of which are periodically alignable to each of the intake ports;

an exhaust port valve assembly fluidly connected to the exhaust ports of the cylinder head assembly, the exhaust port valve assembly comprising at least one rotatable exhaust port cover having spaced apart openings each of which are periodically alignable to each of the exhaust ports, respectively.

2. The radial piston engine of claim 1, wherein the intake port valve assembly and the exhaust port valve assembly are substantially identical.

3. The radial piston engine of claim 1, wherein the intake port valve assembly includes two port cover drivers for rotating the rotatable intake port cover and the rotatable exhaust port cover.

4. The radial piston engine of claim 3, wherein each port cover driver is mechanically driven by a crankshaft.

5. The radial piston engine of claim 3, wherein each port cover driver operate independent of each other.

6. The radial piston engine of claim 1, wherein the intake port valve assembly includes the at least one rotatable intake port cover comprising two independent rotatable port covers.

7. The radial piston engine of claim 6, wherein the two independent rotatable port covers are substantially identical.

8. The radial piston engine of claim 6, wherein the two independent rotatable port covers each includes a plurality of openings, the number of each plurality of openings being at least one greater than the number of cylinders in the cylinder head assembly.

9. The radial piston engine of claim 1, wherein the intake ports and the exhaust ports on the cylinder head assembly are substantially opposite one another.

10. The radial piston engine of claim 9, wherein the intake ports and the exhaust ports are disposed substantially at a 45 degree angle from an upper surface of a piston within the cylinder head assembly.

11. The radial piston engine of claim 9, wherein the rotatable port covers lay flat against the cylinder head assembly.

12. The radial piston engine of claim 1, wherein the intake port valve assembly and the exhaust port valve assembly are controlled by an engine control unit.

13. The radial piston engine of claim 12, wherein the engine control unit includes system inputs to monitor and analyze the radial engine.

14. The radial piston engine of claim 12, wherein the engine control unit includes a system output to adjust engine cycle timing.

15. A radial piston engine containing intake ports and exhaust ports on a cylinder head assembly, the engine comprising:

an intake port valve assembly fluidly connected to the intake ports of the cylinder head assembly, the intake port valve assembly including at least one independent rotatable port cover driver which drives a rotatable intake port cover;

an exhaust port valve assembly fluidly connected to the exhaust ports of the cylinder head assembly, the exhaust port valve assembly including at least one independent rotatable port cover driver which drives a rotatable exhaust port cover;

an engine control unit receiving input data from the engine and transmitting output commands to the port cover driver within the intake port valve assembly and exhaust port valve assembly; and the rotatable intake port cover having a plurality of openings each of which are periodically alignable to each of the intake ports and the rotatable exhaust port cover having a plurality of openings each of which are periodically alignable to each of the exhaust ports.

16. The radial piston engine of claim 15, wherein the intake port valve assembly and the exhaust port valve assembly are substantially identical.

17. The radial piston engine of claim 15, wherein the intake ports and the exhaust ports on the cylinder head assembly are substantially opposite one another.

18. The radial piston engine of claim 17, wherein the intake ports and the exhaust ports are disposed substantially at a 45 degree angle from an upper surface of a piston within the cylinder head assembly.

19. The radial piston engine of claim 17, wherein the rotatable port covers lay flat against the cylinder head assembly.

20. A radial piston engine having a plurality of cylinders, each cylinder having a cylinder head assembly having an intake port and an exhaust port, and a piston which is connected to a crankshaft, the engine comprising:

an intake port valve assembly fluidly connected to the intake ports of the cylinder head assembly, the intake port valve assembly including intake ports disposed substantially at a 45 degree angle from an upper surface of the piston and at least one rotatable independent port cover driver which is mechanically driven by the crankshaft and drives a rotatable intake port cover, which lies flat against the cylinder head assembly and includes a plurality of openings each of which are periodically alignable to each of the intake ports, the number of openings in the rotatable intake port cover being equal to at least one greater than the number of cylinders;

an exhaust port valve assembly fluidly connected to the exhaust ports of the cylinder head assembly, the exhaust port valve assembly including exhaust ports, the exhaust ports substantially opposite the intake ports, and disposed substantially at a 45 degree angle from an upper surface of the piston and at least one rotatable independent port cover driver which is mechanically driven by the crankshaft and drives a rotatable exhaust port cover, which lies flat against the cylinder head assembly and includes a plurality of openings each of which are periodically alignable to each of the exhaust ports, the number of openings in the rotatable exhaust port cover being equal to at least one greater than the number of cylinders.

* * * * *